US007581502B2

(12) United States Patent
Nakao

(10) Patent No.: US 7,581,502 B2
(45) Date of Patent: Sep. 1, 2009

(54) RAIL VEHICLE SYSTEM AND TRANSPORTATION METHOD OF USING THE RAIL VEHICLE SYSTEM

(75) Inventor: Takashi Nakao, Neyagawa (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 213 days.

(21) Appl. No.: 11/476,774

(22) Filed: Jun. 29, 2006

(65) Prior Publication Data

US 2007/0000405 A1 Jan. 4, 2007

(30) Foreign Application Priority Data

Jul. 4, 2005 (JP) ..... 2005-194513

(51) Int. Cl.
*E01B 25/00* (2006.01)
*E01B 25/22* (2006.01)

(52) U.S. Cl. ..... 104/130.07; 104/96; 104/106

(58) Field of Classification Search ..... 104/130.07, 104/106, 96; 105/1.5; 191/22 R; 212/332
See application file for complete search history.

(56) References Cited

U.S. PATENT DOCUMENTS 3,835,788 A * 9/1974 Paul et al. ..... 105/34.1
4,129,203 A * 12/1978 Berman ..... 191/48
7,328,812 B2 * 2/2008 Nakao et al. ..... 212/330
2004/0089190 A1 * 5/2004 Ramu et al. ..... 104/281
2005/0139114 A1 * 6/2005 Nakao et al. ..... 104/96
2005/0139441 A1 * 6/2005 Nakao et al. ..... 191/22 R
2005/0139564 A1 * 6/2005 Nakao et al. ..... 212/71
2005/0159854 A1 * 7/2005 Hori et al. ..... 701/1
2005/0171656 A1 * 8/2005 Hori et al. ..... 701/19
2006/0016363 A1 * 1/2006 Nakao et al. ..... 104/88.01
2006/0161304 A1 * 7/2006 Shiwaku et al. ..... 700/264
2006/0169663 A1 * 8/2006 Nakao et al. ..... 212/319
2006/0180565 A1 * 8/2006 Nakao et al. ..... 212/332
2006/0219126 A1 * 10/2006 Nakao ..... 104/106
2006/0222479 A1 * 10/2006 Shiwaku et al. ..... 414/267
2007/0000405 A1 * 1/2007 Nakao ..... 104/130.07

FOREIGN PATENT DOCUMENTS

JP 6-87436 A 3/1994
JP 06087436 A * 3/1994
JP 08292813 A * 11/1996

(Continued)

OTHER PUBLICATIONS

Notification for Reason(s) of Refusal dated Aug. 21, 2008 for Japanese Patent Application No. 2005-194513.

*Primary Examiner*—S. Joseph Morano
*Assistant Examiner*—Jason C Smith
(74) *Attorney, Agent, or Firm*—Westerman, Hattori, Daniels & Adrian, LLP.

(57) ABSTRACT

In a branch section 1 or a merge section of a rail vehicle system, an auxiliary travel surface 17 on the straight lane side includes a deformed portion 54 where the height is increased for supporting an auxiliary wheel 6 of a traveling vehicle 2. The traveling vehicle 2 is supported by the auxiliary wheel 6 and guide rollers 24, 20 such that the traveling vehicle 2 is orientated horizontally in the left-right direction, or the branch lane side D of the traveling vehicle 2 is oriented slightly upwardly.

4 Claims, 6 Drawing Sheets

FOREIGN PATENT DOCUMENTS

| | | | | |
|---|---|---|---|---|
| JP | 2002-321615 | A | | 11/2000 |
| JP | 2001-270435 | A | | 10/2001 |
| JP | 2001-328530 | A | | 11/2001 |
| JP | 2002-087251 | A | | 3/2002 |
| JP | 2003-160047 | A | | 6/2003 |
| JP | 2003-212113 | A | | 7/2003 |
| JP | 2005206306 | A | * | 8/2005 |

* cited by examiner

8

1

RAIL VEHICLE SYSTEM AND TRANSPORTATION METHOD OF USING THE RAIL VEHICLE SYSTEM

TECHNICAL FIELD

The present invention relates to a system of rail vehicles such as overhead traveling vehicles, and a method of using the system. In particular, the present invention relates to a technique for allowing the rail vehicle to travel straight through a branch section or a merge section smoothly at high speed.

BACKGROUND ART

The rail vehicle system includes a travel rail having branch sections and merge sections. The branch section and the merge section have the same structure except that the travel direction in the branch section is opposite to the travel direction in the merge section. The branch section includes a straight lane and a branch lane with a curve. The merge section includes a straight lane and a merge lane with a curve. In the branch section or the merge section, a gap as a discontinuous portion of a travel surface is present. In order to reduce the impact when the rail vehicle passes the gap, it has been customary to provide auxiliary wheels inside the left and right travel wheels. In the specification, the shift from the state where the travel wheel rides on the ground to the state where the auxiliary wheel rides on the ground is referred to as the "wheel shift".

In the case where the rail vehicle is on the straight lane of the branch section or the merge section, normally, the rail vehicle travels at high speed in comparison with the case where the rail vehicle is on the branch lane or the merge lane. If the wheel shift operation is performed when the rail vehicle travels at high speed, at the moment the auxiliary wheels land on the travel surface, an impact is applied to the travel surface. As a result, the travel surface is vibrated to generate vibration of the rail vehicle or noises. For example, the travel surface for landing of the auxiliary wheel has a triangular shape protruding toward the inside of the branch section or the merge section, and the rigidity of the travel surface is not sufficient. Since the auxiliary wheel lands on the front end of the travel surface, the travel surface can be vibrated easily. The vibration at the time of the wheel shift adversely affects the rail vehicle, the transported article, and the travel rail. Therefore, the rail vehicle cannot travel straight through the branch section or the merge section at high speed smoothly. The inventor studied to reduce the vibration which is generated when the rail vehicle travels straight though the straight lane of the branch section or the merge section, and achieved the present invention.

SUMMARY OF THE INVENTION

An object of the present invention is to allow a rail vehicle to travel straight through a branch section or a merge section smoothly.

Secondary object of the present invention is to provide specific structure to achieve the above object.

Secondary object of the present invention is to make it possible to control the orientation of the rail vehicle simply by specially fabricating a travel rail without any modification to the rail vehicle.

According to the present invention, a rail vehicle system comprises:

a rail vehicle having left and right travel wheels;

a travel rail having left and right travel surfaces, the left and right travel surfaces being separated from each other to form a space between the left and right travel surfaces for supporting the left and right travel wheels, the travel rail having a discontinuous portion in one of the left and right travel surfaces to form a gap in a branch section or a merge section of the rail; and orientation control means for controlling orientation of the rail vehicle near the gap by floating the travel wheel on the gap side above the travel surface such that the travel wheel on the side opposite to the gap supports the rail vehicle.

The meaning of "floating the travel wheel on the gap side" includes the case where the travel wheel on the gap side is lowered from the position floated by the orientation control means due to deflection of the travel rail, and the travel rail contacts the travel surface at substantially the zero pressure.

Preferably, the left and right travel wheels comprise left and right normal wheels and left and right auxiliary wheels inside the normal left and right wheels in the left-right direction;

the travel rail includes left and right guides for guiding the rail vehicle traveling through the branch section or the merge section, the left and right guides being provided outside the left and right auxiliary wheels in the left-right direction, at the height where the left and right guides do not contact the travel wheels;

the rail vehicle includes guide rollers guided by the left and right guides; and the orientation control means lifts the auxiliary wheel upwardly relative to the normal wheel, on the side opposite to the gap.

Preferably, for traveling through the branch section and the merge section, the left and the right travel surfaces are configured such that, when the rail vehicle travels along a straight lane, both of the travel wheel and the auxiliary wheel on the side opposite to the gap are supported by the travel surface, and after the rail vehicle passes the gap, the auxiliary wheel on the gap side is supported by the travel surface firstly, and then, the normal wheel on the gap side is supported by the travel surface; and when the rail vehicle travels along a branch lane or a merge lane, the normal wheel on the gap side is supported by the travel surface, and after the rail vehicle passes the space between the left and right travel surfaces, the auxiliary wheel on the side opposite to the gap is supported by the travel surface firstly, and then, the normal wheel on the side opposite to the gap is supported by the travel surface.

In particular, preferably, on the side opposite to the gap, the orientation control means is configured to shift the travel surface on the auxiliary wheel side upwardly relative to the travel surface on the normal wheel side.

Most preferably, on the side opposite to the gap, the travel surface on the auxiliary wheel side is shifted upwardly in comparison with the travel surface on the normal wheel side, and the height of the travel surface on the normal wheel side is substantially the same as the travel surface at positions other than the gap.

Preferably, on the side opposite to the gap, the travel surface on the normal wheel side is shifted downwardly in comparison with the travel surface on the auxiliary wheel side, and the height of the travel surface on the auxiliary wheel side is substantially the same as the height of the travel surface at positions other than the gap.

According to the present invention, in a transportation method, a rail vehicle having left and right travel wheels is used, and a travel rail having left and right travel surfaces is used, the left and right travel surfaces being separated from each other to form a space between the left and right travel surfaces for supporting the left and right travel wheels, the travel rail having a discontinuous portion in one of the left and right travel surfaces to form a gap in a branch section or a merge section of the rail, the method comprising the step of:

controlling orientation of the rail vehicle near the gap by floating the travel wheel on the gap side above the travel surface such that the travel wheel on the side opposite to the gap supports the rail vehicle.

Preferably, the left and right travel wheels comprise left and right normal wheels and left and right auxiliary wheels inside the normal left and right wheels in the left-right direction;

the travel rail includes left and right guides for guiding the rail vehicle traveling through the branch section or the merge section, the left and right guides being provided outside the left and right auxiliary wheels in the left-right direction, at the height where the left and right guides do not contact the travel wheels;

the rail vehicle includes guide rollers guided by the left and right guides; and in the orientation control step, the auxiliary wheel is lifted upwardly relative to the normal wheel, on the side opposite to the gap.

In particular, preferably, for traveling through the branch section and the merge section, the left and the right travel surfaces are configured such that, when the rail vehicle travels along a straight lane, both of the travel wheel and the auxiliary wheel on the side opposite to the gap are supported by the travel surface, and after the rail vehicle passes the gap, the auxiliary wheel on the gap side is supported by the travel surface firstly, and then, the normal wheel on the gap side is supported by the travel surface; and when the rail vehicle travels along a branch lane or a merge lane, the normal wheel on the gap side is supported by the travel surface, and after the rail vehicle passes the space between the left and right travel surfaces, the auxiliary wheel on the side opposite to the gap is supported by the travel surface firstly, and then, the normal wheel on the side opposite to the gap is supported by the travel surface.

In the present invention, when the rail vehicle passes the gap, the travel wheel on the gap side is floated above the travel surface by the orientation control means. Therefore, the travel wheel on the gap side does not contact the travel surface. Even if the travel wheel contacts the travel surface, the contact pressure is small in comparison with the other positions. Therefore, the vibration or the noises at the time the rail vehicle passes the positions before, and after the gap is reduced. Thus, the rail vehicle can smoothly travel straight through the branch section or the merge section. For example, the rail vehicle can travel through the branch section or the merge section at high speed, or the durability of the travel rail and the rail vehicle or the load applied to the transported article is reduced.

In the case where the travel rail has left and right guides outside the left and right auxiliary wheels in the left-right direction for guiding the rail vehicle to travel along the branch lane or the merge lane, the guides function as supports for preventing wobbling in the surface perpendicular to the travel direction of the rail vehicle. Therefore, the moment of the support force applied to the auxiliary wheels and the moment of the gravity force of the rail vehicle are offset. If the auxiliary wheels are lifted upwardly relative to the normal wheels on the side opposite to the gap, the normal wheel and the auxiliary wheel on the gap side can be floated above the travel surface easily.

Simply by specially fabricating the travel rail on the side opposite to the gap such that the travel surface on the auxiliary wheel side is shifted upwardly relative to the travel surface on the normal wheel side, it is possible to float the normal wheels and the auxiliary wheels on the gap side. Further, it is possible to easily manufacture the travel rail having the structure in which the vertical shift of the travel surface starts gently, and ends gently. Thus, the support force can be shifted between the travel wheel on the gap side and the auxiliary wheel on the side opposite to the gap.

BRIEF DESCRIPTION OF THE DRAWINGS

In FIG. 1, chain lines show travel surfaces for supporting travel wheels.

In FIG. 2, chain lines show guides for allowing the traveling vehicles to travel along a straight lane or a branch lane.

Brief Description of the Synbols

Figure 1:
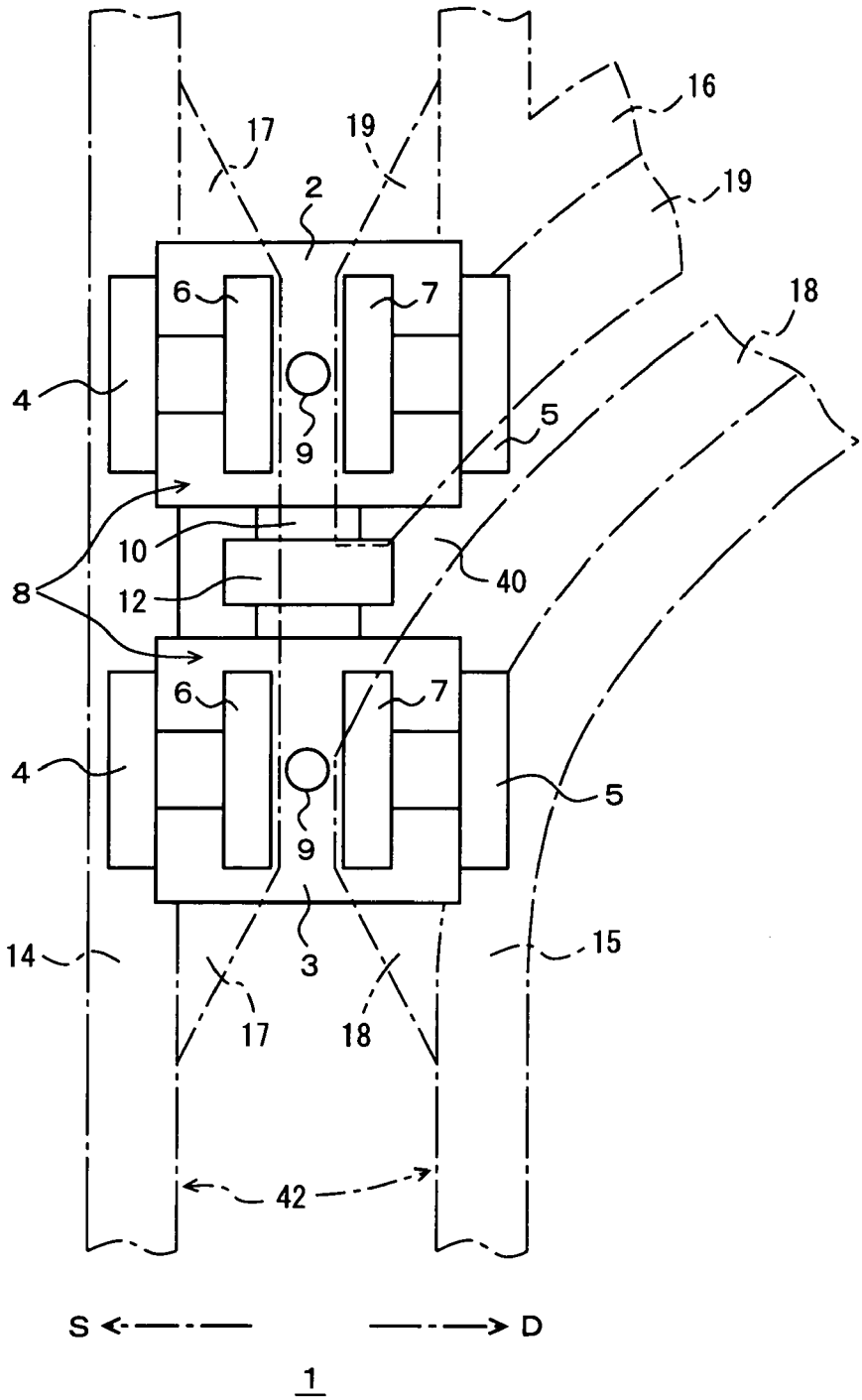
FIG. 1 is a bottom view showing a pair of front and rear traveling vehicles according to an embodiment.

| | | | |
|---|---|---|---|
| 1 | Branch section | 2, 3 | Traveling vehicle |
| 2' | Traveling vehicle | 4, 5 | Travel wheel |
| 6, 7 | Auxiliary wheel | 8 | Overhead traveling vehicle |
| 9 | Shaft | 10 | Joint |
| 12 | Travel motor | 13 | Travel drive wheel |
| 14-16 | Travel surface | 17-19 | Auxiliary travel surface |
| 20-26 | Guide roller | 28-32 | Guide |
| 34, 36 | Wide section | 40 | Gap |
| 42, 42' | Travel rail | 44 | Power feeding rail |
| 46 | Litz wire | 48 | Power receiving unit |
| 50 | Overhead traveling vehicle body | 52 | Support section |
| 54 | Deformed section | 56-60 | Change pattern of supporting force |
| 62-66 | Support state | 70 | Orientation guide roller |
| 72 | Press-down surface | 74 | Recess |
| 76 | Biasing means | S | Straight lane |
| D | Branch lane | | |

EMBODIMENT

Hereinafter, an embodiment in the most preferred form for carrying out the present invention will be described.

FIGS. 1 to 6 show an embodiment using an overhead traveling vehicle as a rail vehicle. In the drawings, a reference numeral 1 denotes a branch section, and the branch section is similar to a merge section. Reference numerals 2 and 3 denote a pair of front and rear traveling vehicles. In the drawings, the front traveling vehicle is denoted by the reference numeral 2, and the rear traveling vehicle is denoted by the reference numeral 3. Normal travel wheels 4, 5 are provided on left and right sides of the traveling vehicles 2, 3. Further, auxiliary wheels 6, 7 are provided inside the travel wheels 4, 5 in the left-right direction. For example, the auxiliary wheels 6, 7 have the diameter same as that of the travel wheels 4, 5. A reference numeral 8 denotes the entire overhead traveling vehicle. Reference numerals 9 denote shafts connecting an overhead traveling vehicle body 50 and the traveling vehicles 2, 3. Reference numeral 10 denotes a joint coupling the front and rear traveling vehicles 2, 3 together. A reference numeral 12 denotes a travel motor, and a reference numeral 13 denotes a travel drive wheel. The travel drive wheel 13 is driven by drive means (not shown) and contacts a ceiling surface of a travel rail 42 for allowing the traveling vehicles 2, 3 to travel along the travel rail 42.

Positions of travel surfaces 14 to 19 of the travel rail 42 are shown by chain lines or the like in FIG. 1. A straight travel surface 14 is provided along a straight lane S in the branch section 1. A curved travel surface 15 is provided on the upstream side of a branch lane D in the branch section 1. A travel surface 16 with a protruded front end is provided on the downstream side of the branch lane D. The travel wheels 4 on the straight lane side are supported by the travel surface 14, and the travel wheels 5 on the branch lane side are supported by the travel surfaces 15, 16. In the branch section 1, the travel surface 14 is expanded inwardly in the left-right direction to form an auxiliary travel surface 17 for supporting the auxiliary wheels 6. The travel surfaces 15, 16 are expanded inwardly to form auxiliary travel surfaces 18, 19, respectively, for supporting the auxiliary wheels 7 or the like. The auxiliary travel surfaces 17 to 19 may be provided in travel segments other than the branch section 1, such as a straight travel segment. Further, a gap (discontinuous position of the travel surface) 40 is present between the auxiliary travel surfaces 18, 19.

Figure 2:
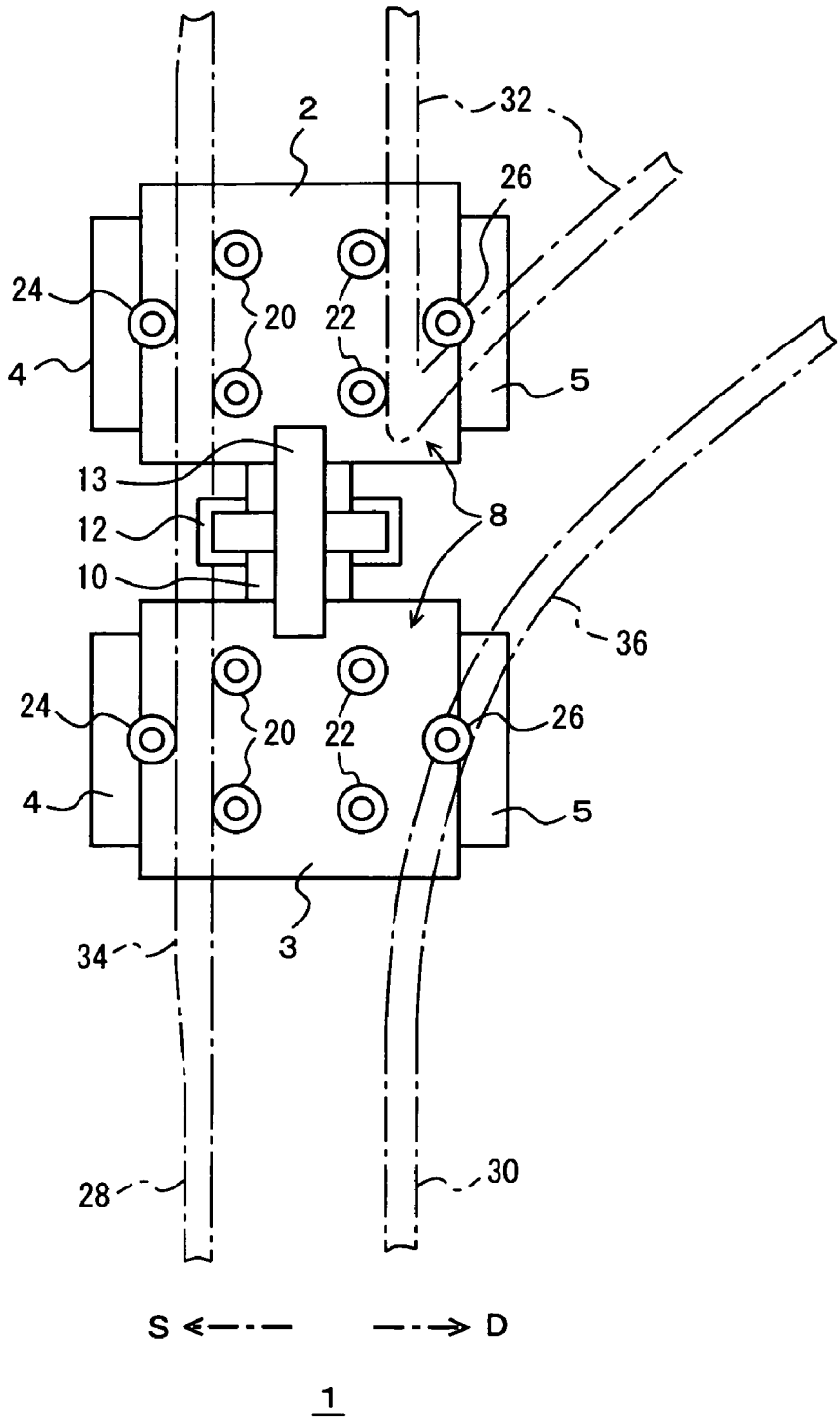
FIG. 2 is a plan view showing the pair of front and rear traveling vehicles according to the embodiment.

For example, as shown in FIG. 2, each of the traveling vehicles 2, 3 includes guide rollers 20, 22 provided at inner positions in the left-right direction, and guide rollers 24, 26 provided at outer positions in the left-right direction. For example, the height of the guide rollers 20, 22 is fixed, and the height of the guide rollers 24, 26 can be changed. Guides 28 to 32 are provided above the travel rail. The guide rollers 20 to 26 are guided on both surfaces of the guides 28 to 32. In the structure, the traveling vehicles 2, 3 can move along the straight lane or the branch lane under control. The guides 28, 30 have wide sections 34, 36. The guide rollers 20, 24 tightly contact both left and right sides of the wide section 34 without any gap, and the guide rollers 22, 26 tightly contact both left and right sides of the wide section 36 without any gap. In the straight travel segment or the like, the guides 28, 30 are narrow in comparison with the wide sections 34, 36. Therefore, only the inner guide rollers 20, 22 contact the guides 28, 30, and the outer guide rollers 24, 26 do not contact the guides 28, 30. Thus, in the case of straight traveling in the branch section 1, the wide section 34 functions as a support section for preventing wobbling in the surface perpendicular to the travel direction of the traveling vehicles 2, 3.

In the case of straight traveling in the branch section 1, the guide rollers 24 on the straight lane side are lifted, and the guide rollers 26 on the branch lane side are lowered such that the guide rollers 26 can pass under the bottom of the wide section 36. The guide rollers 20, 24 are guided on both left and right surfaces of the wide section 34 to travel along the straight lane. In the case of branch traveling, the guide rollers 24 are lowered, and the guide rollers 26 are lifted for guiding the guide rollers 22, 26 on both sides of the wide section 36 to travel along the branch lane.

Figure 3:
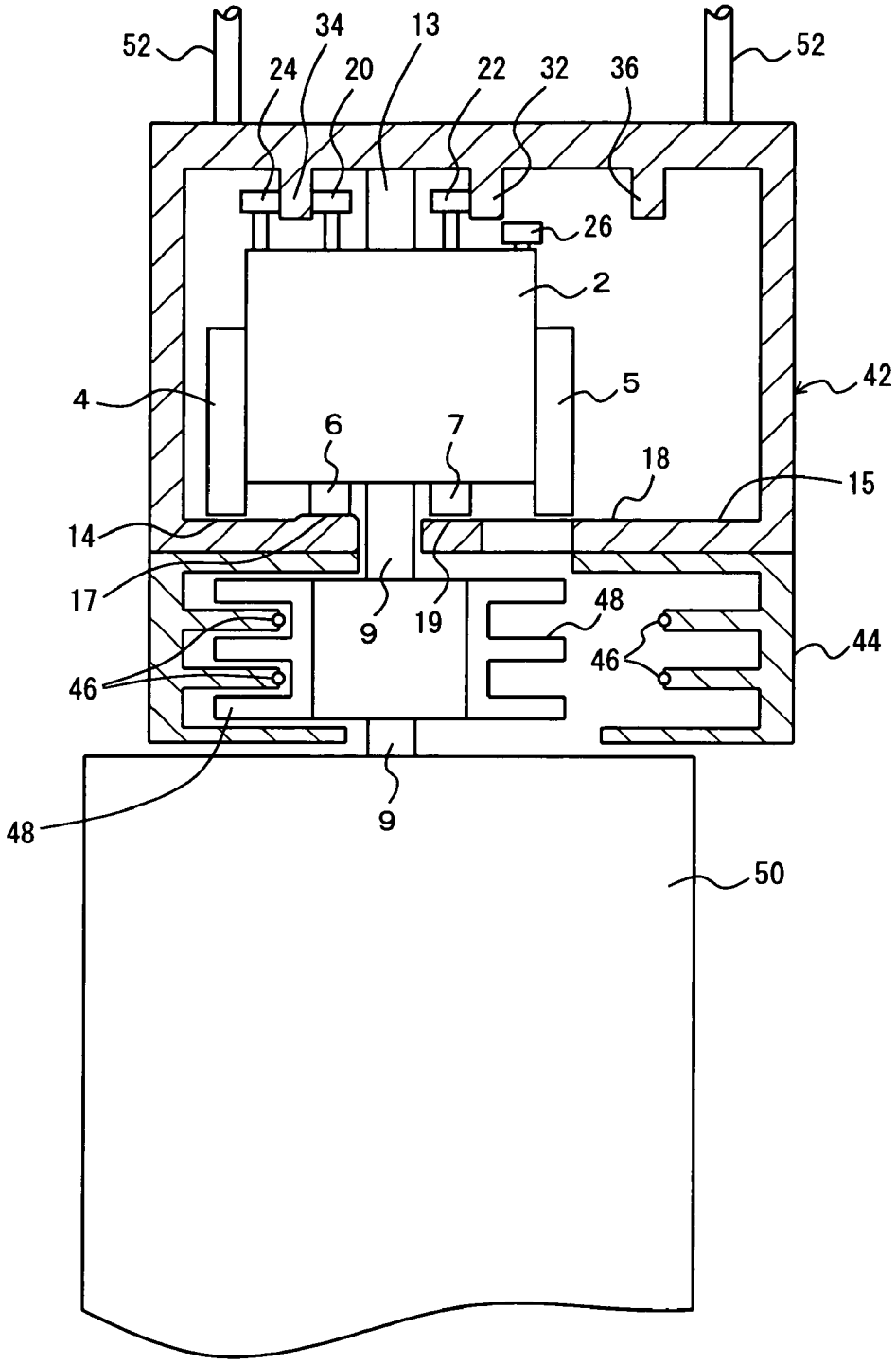
FIG. 3 is a front view showing a cross section of a travel rail of a branch section and a front surface of an overhead traveling vehicle in the middle of moving straight.

For example, as shown in FIG. 3, a power feeding rail 44 is provided vertically under the travel rail 42 for supplying electricity to a power receiving unit 48, e.g., in a non-contact manner through litz wires 46. Further, communication between the overhead traveling vehicles 8 or between the overhead traveling vehicle 8 and a controller (not shown) is performed using the litz wires 46. The overhead traveling vehicle body 50 is provided under the power receiving unit 48, and the overhead traveling vehicle body 50 is supported by the shafts 9. For example, a lateral feeding unit, a horizontal rotation unit, and an elevation drive unit, and an elevation frame are provided. By winding/unwinding operation of a hanging member of the elevation drive unit, the elevation frame is elevated/lowered, and the elevation drive unit is rotated in the horizontal surface by the horizontal rotation unit. The lateral feeding unit laterally feeds the horizontal rotation unit, the elevation drive unit, and the elevation frame in the direction perpendicular to the travel direction of the travel rail 42. The structure of the overhead traveling vehicle body 50 can be designed arbitrarily. Further, a reference numeral 52 denotes a support section for the travel rail 42.

Figure 4:
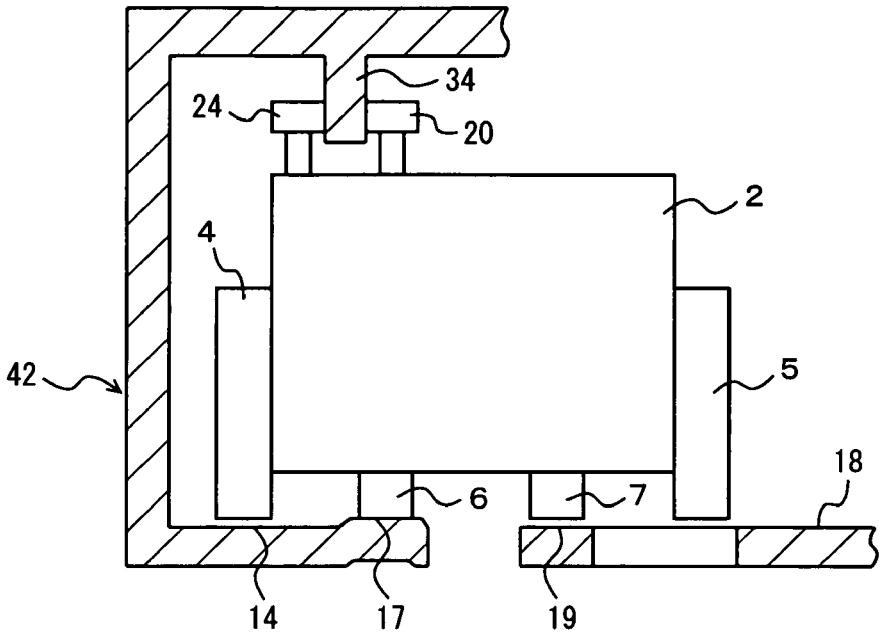
FIG. 4 is an enlarged view showing main part in FIG. 3.

FIG. 4 is a view showing a cross section of the travel rail 42 around the gap 40. The auxiliary travel surface 17 is lifted to a position higher than the travel surface 14 by, e.g., several millimeters. As a result, the travel wheels 4 float slightly above the travel surface 14 or the contact pressure between the travel wheels 4 and the travel surface 14 becomes small in comparison with the other travel segments. Likewise, the travel wheels 5 or the auxiliary wheels 7 float slightly above the auxiliary travel surfaces 18, 19, or the contact pressure between the travel wheels 5 or the auxiliary wheels 7 and the auxiliary travel surfaces 18, 19 becomes small in comparison with the other travel segments. The guide rollers 20, 24 contact the wide section 34. The center of the wide section 34 in the left-right direction is positioned outside the traveling vehicle 2, from the center of the auxiliary wheels 6 in the left-right direction. Therefore, the supporting force applied from the auxiliary travel surface 17 to the auxiliary wheels 6 is operated to float the travel wheels 5 and the auxiliary wheels 7 above the auxiliary travel surfaces 18, 19, and partially offset the moment of the gravity force of the traveling vehicles 2, 3.

In the case where the load from the traveling vehicle 2 is not applied to the auxiliary travel surface 17, the auxiliary travel surface 17 is higher than the auxiliary travel surfaces 18, 19 and the travel surface 14 by, e.g., several millimeters. When the traveling vehicles 2, 3 actually travel on the auxiliary travel surface 17, since the load from the traveling vehicles 2, 3 is applied to the auxiliary travel surface 17, the auxiliary travel surface 17 is deformed, and becomes higher than the travel surface 14 and the auxiliary travel surfaces 18, 19 by 0 mm to 2 mm near the gap. It should be noted that it is difficult to match the height of the travel surface 14 and the height of the auxiliary travel surfaces 18, 19 perfectly. Therefore, it is preferable that the auxiliary travel surface 17 becomes slightly higher than the auxiliary travel surfaces 18, 19 by, e.g., 0.1 mm to 1 mm while the traveling vehicles 2, 3 are traveling.

Figure 5:
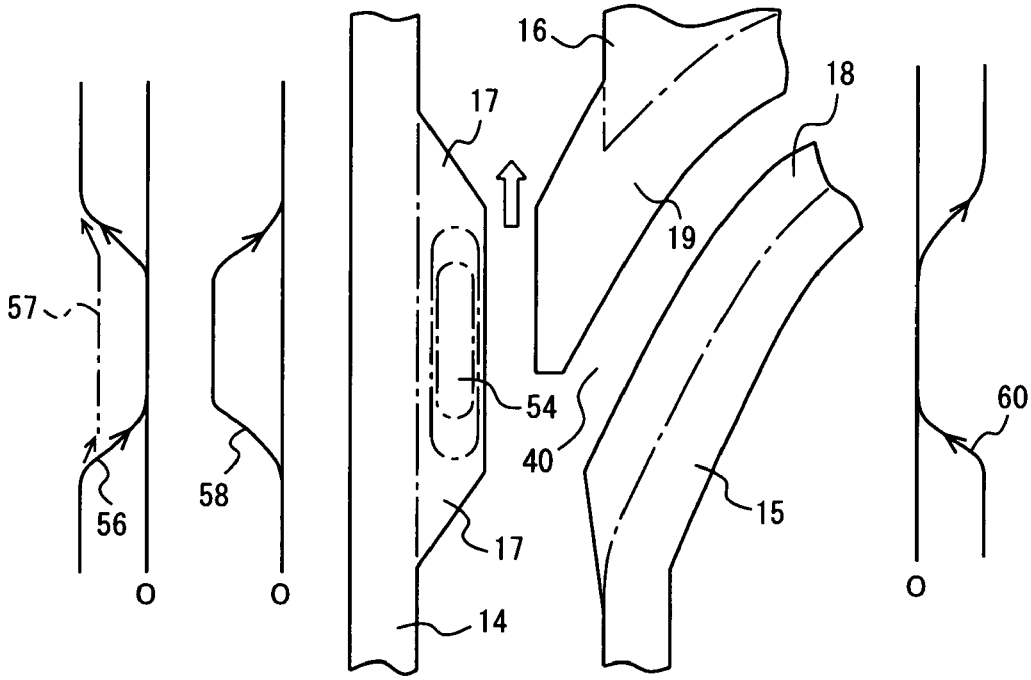
FIG. 5 is a view showing the height of the travel surface in the branch section in contour lines, and showing the change in the supporting force at the left and right travel wheels and a left auxiliary wheel.

FIG. 5 shows a deformed section 54 formed by shifting the auxiliary travel surface 17 upwardly. Chain lines around the deformed section 54 are contour lines. In the straight moving direction of the auxiliary wheels 6, the deformed section 54 is gently inclined upwardly, and becomes flat. Then, the deformed section 54 is gently inclined downwardly again.

Further, since the travel wheels 4 pass the deformed section 54 at the time of traveling along the branch lane, also in the left-right direction, it is preferable that the deformed section 54 is gently inclined upwardly, and then, gently inclined downwardly.

Further, FIG. 5 shows a change pattern 56 of the supporting force at the travel wheel 4, a change pattern 58 of the supporting force at the auxiliary wheel 6, and a change pattern 60 of the supporting force at the travel wheel 5 from the left side to the right side. At the top surface of the deformed section 54, in effect, the auxiliary wheel 6 supports the whole load, and the supporting forces of the travel wheels 4, 5 and the supporting force of the auxiliary wheel 7 on the branch lane side are substantially "0". The supporting force of the auxiliary wheel 6 on the straight lane side gently changes between the top surface and the end of the deformed section 54. Accordingly, the travel wheel 5 on the branch lane side gently leaves the auxiliary travel surface 18, and gently contacts the auxiliary travel surface 19. When the auxiliary wheel 7 passes the gap 40, the auxiliary wheel 7 does not contact the auxiliary travel surfaces 18, 19. Further, the supporting force of the travel wheel 4 on the straight lane side may be changed as shown by a chain line 57 such that the load is partially supported by the travel wheel 4 on the straight lane side also in the deformed section 54.

Figure 6:
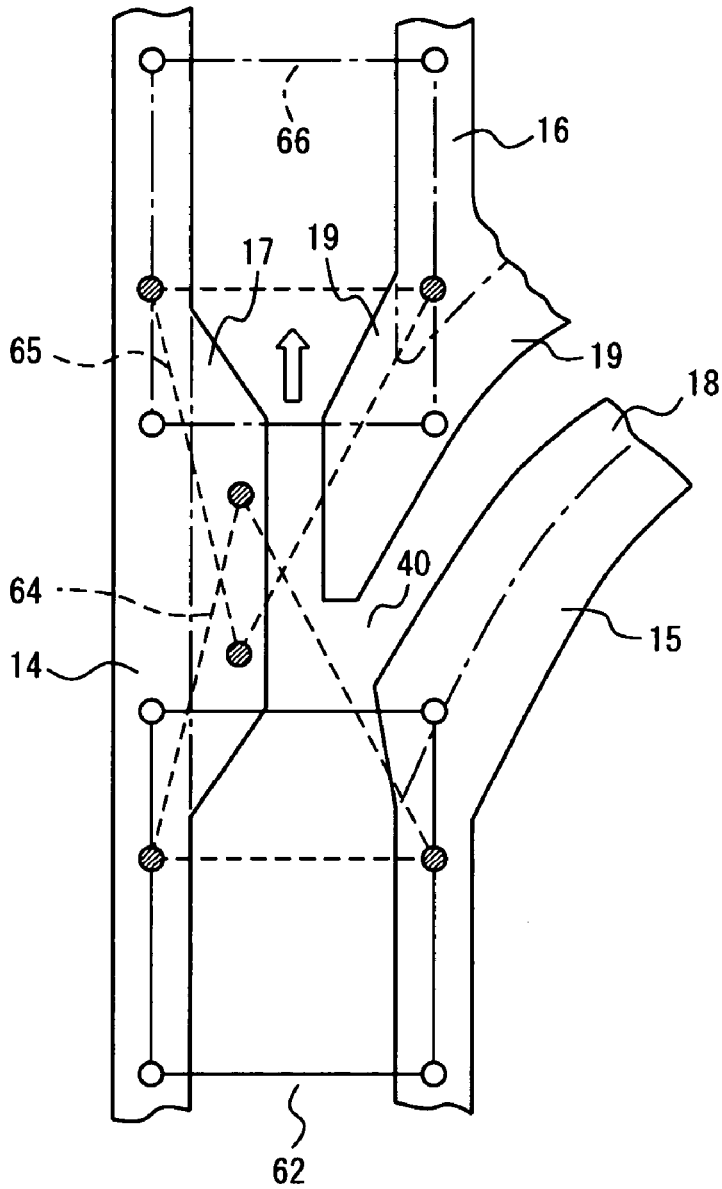
FIG. 6 is a view showing positions of supporting the load of the front and rear traveling vehicles in the branch section.

FIG. 6 schematically shows the change of the support state when the overhead traveling vehicle travels through the branch section 1. It is assumed that the overhead traveling vehicle travels from the lower side to the upper side in FIG. 6. At a position ahead of the gap 40, as in the support state 62, the overhead traveling vehicle is supported at four positions, i.e., by the front left and right travel wheels, and the rear left and right travel wheels. When the front traveling vehicle travels through the gap 40, as in the support state 64, the overhead traveling vehicle is supported at three positions, i.e., by the front auxiliary wheel and the rear left and right travel wheels. After the front traveling vehicle passes the gap 40, and the rear traveling vehicle is in the middle of passing the gap 40, as in the support state 65, the overhead traveling vehicle is supported at three positions, i.e., by the front left and right travel wheels and the rear auxiliary wheel. After both of the front and rear traveling vehicles pass the gap 40, as in the support state 66, the overhead traveling vehicle is supported at four positions, i.e., by the front left and right travel wheels and the rear left and right travel wheels. As described above, when the overhead traveling vehicle passes the gap 40, regardless of the positions of the front and rear traveling vehicles, the center of the supporting points as the three wheels are not shifted significantly in the left-right direction. It is because, in the support states 64, 65, one of the front and rear auxiliary wheels is supported on the auxiliary travel surface 17. As a result, it is possible to prevent the center of the gravity of the overhead traveling vehicle from being deviated from the center of the supporting points in the left-right direction. In the structure, since the impact at the time of the wheel shift between the state where the overhead traveling vehicle is traveling on the auxiliary travel surface 18 and the state where the overhead traveling vehicle is traveling on the auxiliary travel surface 19 is eliminated, the overhead traveling vehicle can travel through the gap smoothly.

Figure 7:
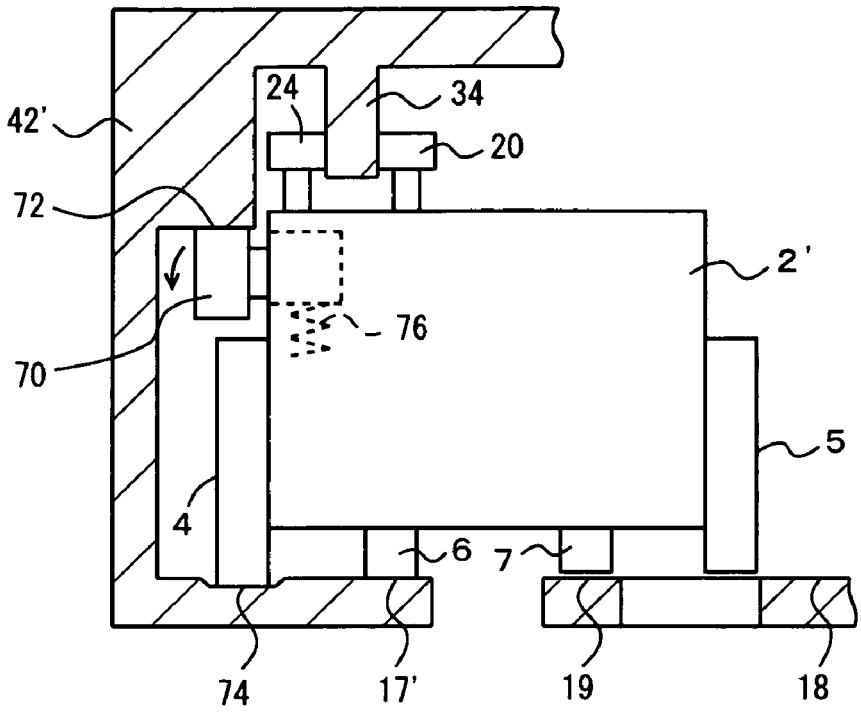
FIG. 7 is a view showing a manner of controlling the orientation of the overhead traveling vehicle in the middle of moving straight through the branch section according to a modified embodiment.
Figure 8:
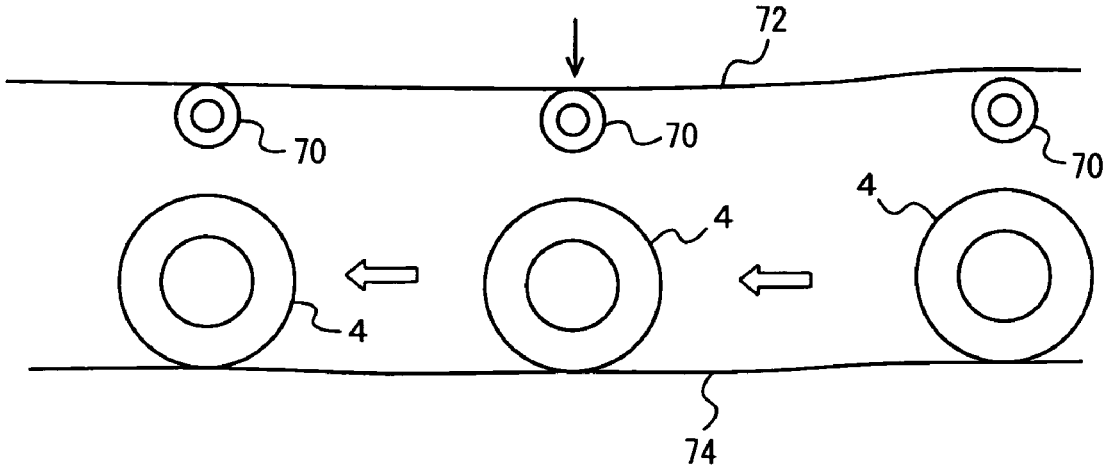
FIG. 8 is a view showing the change in the heights of a left travel wheel and an orientation guide roller according to the modified embodiment.

FIGS. 7 and 8 show a traveling vehicle 2' according to a modified embodiment. The rear traveling vehicle on the back side in the moving direction may also have the same structure. The structure of the traveling vehicle 2' according to the modified embodiment is same as the structure of the traveling vehicle 2 according to the embodiment shown in FIGS. 1 to 6, other than the points as specifically described below. A reference numeral 70 denotes an orientation guide roller provided on the straight lane side of the branch section or the merge section. A reference numeral 72 denotes a press-down surface of a travel rail 42' for pressing the orientation guide roller 70 downwardly. Further, a recess 74 is provided on the travel surface of the travel wheel 4 near the gap. A reference numeral 76 denotes biasing means such as a spring. The biasing means may not be provided. When the traveling vehicle 2' passes a position near the gap, since the orientation guide roller 70 is pressed downwardly, the travel wheel 4 is lowered toward the recess 74. In the modified embodiment shown in FIGS. 7 and 8, a flat auxiliary travel surface 17' is provided. Since the travel wheel 4 is lowered toward the recess 74, and the auxiliary wheel 6 supports the traveling vehicle 2', the traveling vehicle 2' slightly changes its orientation such that the travel wheel 5 and the auxiliary wheel 7 float above the auxiliary travel surfaces 18, 19. In the structure, the traveling vehicle 2' is mainly supported by the auxiliary wheel 6, and passes the position near the gap.

In the embodiment and the modified embodiment, the following advantages can be obtained.

(1) When the overhead traveling vehicle passes a position near the gap, the travel wheels 5 and the auxiliary wheels 7 float slightly above the auxiliary travel surfaces 18, 19 or contact these surfaces 18, 19 lightly. Therefore, the impact at the time of shifting from the auxiliary travel surface 18 to the auxiliary travel surface 19 can be avoided.

(2) By the control of the orientation of the traveling vehicle 2 or the like, the balance of the supporting force changes gently between the state where the load is supported mainly by the auxiliary wheel 6 and the state where the travel wheel 5 on the branch lane side contacts the auxiliary travel surfaces 18, 19. Thus, the travel wheel 5 gently leaves the auxiliary travel surface 18, and gently rides on the auxiliary travel surface 19. Accordingly, the overhead traveling vehicle smoothly travels straight through the branch section.

(3) The embodiment of FIGS. 1 to 6 can be carried out simply by providing the deformed section 54 on the auxiliary travel surface 17, and conventional vehicles can be used as the traveling vehicles 2, 3.

(4) Since the impact at the time of wheel shift from the auxiliary travel surface 18 to the auxiliary travel surface 19 is reduced, the vibration or noises generated during the wheel shift are reduced. Therefore, the durability of the travel rail and the durability of the overhead traveling vehicle are improved. Further, the force applied to the transportation article such as a semiconductor wafer is reduced.

(5) In the embodiment of FIGS. 1 to 6, when the overhead traveling vehicle travels straight through the branch section at the speed of 200 m per minute, the maximum acceleration in the vertical direction in the branch section as the level of vibration can be reduced 60% in comparison with the case where the deformed section 54 is not provided.

Although the embodiment has been described in connection with the case where the overhead traveling vehicle travels straight though the branch section 1, the present invention is also applicable to the case where the overhead traveling vehicle travels straight through the merge section. That is, the structure of the branch section 1 with modification where the downstream side and the upstream side of the travel rails 42, 42' are reversed corresponds to the structure of the merge section. In the case where the overhead traveling vehicle travels through the branch section 1 along the branch lane, or in the case where the overhead traveling vehicle moves into the merge section while traveling along a curve, in consideration of the curve, the traveling speed of the overhead traveling vehicle needs to be low in comparison with the case where the overhead traveling vehicle travels straight, and the impact at the time of wheel shift is small. Therefore, it is sufficient that only the case where the overhead traveling vehicle travel straight through the branch section or the merge section is considered. Further, in the case of the modified embodiment of FIGS. 7 and 8, if the orientation guide roller 70, the press-down surface 72, and the recess 74 are provided also on the side where the overhead travel vehicles travels along the branch lane on the left or the right sides, or on the side where the overhead traveling vehicle moves into the merge section while traveling along a curve, it is possible to reduce the impact of traveling along the branch lane or the like. Although the embodiment has been described in connection with the overhead traveling vehicle as an example, the height of the travel rail can be determined arbitrarily. The present invention is also applicable to the case where the vehicle travels on the ground, as long as there is a gap between travel surfaces on the side of the branch lane or the curving lane leading to the merge section. Further, although the embodiment has been described in connection with the case where the traveling vehicles 2, 3 have the auxiliary wheels 6, 7, the present invention is applicable to the case where the auxiliary wheels 6, 7 are not provided. In this case, the deformed section 54 is provided on the side of the travel vehicle 4 for allowing the overhead traveling vehicle to pass the gap.

In addition to the above, the inventor tried to reduce the impact at the time of wheel shift, by increasing the rigidity of the auxiliary travel surface 19. However, since the auxiliary travel surface 19 protrudes toward the inside of the branch section, it was difficult to increase the rigidity, and reduce the impact at the time of wheel shift. Further, the inventor attempted to change the auxiliary wheels 6, 7 into two front and rear wheels having the smaller diameter, and make the shifting to occur at an earlier timing so that, when the overhead traveling vehicle passes the gap 40, the front auxiliary wheel contacts the auxiliary travel surface 19, before the travel wheel 5 leaves the auxiliary travel surface 18. However, the reduction in the impact was small.

The invention claimed is:

1. A rail vehicle system comprising:

a rail vehicle having left and right travel wheels;

a travel rail having left and right travel surfaces, the left and right travel surfaces being separated from each other to form a space between the left and right travel surfaces for supporting the left and right travel wheels, the travel rail having a discontinuous portion in one the left and right travel surfaces to form a gap in at least one of a branch section and a merge section of the rail; and orientation control means for controlling orientation of the rail vehicle near the gap by floating the travel wheel on the gap side above the travel surface such that the travel wheel on the side opposite to the gap supports the rail vehicle; wherein the left and right travel wheels comprise left and right normal wheels and left and right auxiliary wheels inside the normal left and right wheels in the left-right direction;

the travel rail includes left and right guides for guiding the rail vehicle travelling through at least one of the branch section and the merge section, the left and right guides being provided outside the left and right auxiliary wheels in the left-right direction, at the height where the left and right guides do not contact the travel wheels;

the rail vehicle includes guide rollers guided by the left and right guides;

the orientation control means lifts the auxiliary wheel upwardly relative to the normal wheel, on the side opposite to the gap; and on the side opposite to the gap, the orientation control means is configured to shift the travel surface on the auxiliary wheel side upwardly relative to the travel surface on the normal wheel side.

2. The rail vehicle system of claim 1, wherein, on the side opposite to the gap, the travel surface on the auxiliary wheel side is shifted upwardly in comparison with the travel surface on the normal wheel side, and the height of the travel surface on the normal wheel side is substantially the same height as the travel surface at positions other than the gap.

3. The rail vehicle system of claim 1, wherein, on the side opposite to the gap, the travel surface on the normal wheel side is shifted downwardly in comparison with the travel surface on the auxiliary wheel side, and the height of the travel surface on the auxiliary wheel side is substantially the same height as the travel surface at positions other than the gap.

4. The rail vehicle system of claim 1, wherein, for traveling through the branch section and the merge section, the left and the right travel surfaces are configured such that, when the rail vehicle travels along a straight lane, both of the travel wheel and the auxiliary wheel on the side opposite to the gap are supported by the travel surface, and after the rail vehicle passes the gap, the auxiliary wheel on the gap side is supported by the travel surface firstly, and then, the normal wheel on the gap side is supported by the travel surface; and when the rail vehicle travels along at least one of a branch lane and a merge lane, the normal wheel on the gap side is supported by the travel surface, and after the rail vehicle passes the space between the left and right travel surfaces, the auxiliary wheel on the side opposite to the gap is supported by the travel surface firstly, and then, the normal wheel on the side opposite to the gap is supported by the travel surface.

* * * * *